US007523844B2

(12) United States Patent
Garcia

(10) Patent No.: US 7,523,844 B2
(45) Date of Patent: Apr. 28, 2009

(54) FLUID DISPENSER

(75) Inventor: Firmin Garcia, Evreux (FR)

(73) Assignee: Valois S.A.S., Le Neubourg (FR)

( * ) Notice: Subject to any disclaimer, the term of this patent is extended or adjusted under 35 U.S.C. 154(b) by 454 days.

(21) Appl. No.: 11/016,752

(22) Filed: Dec. 21, 2004

(65) Prior Publication Data

US 2005/0139614 A1 Jun. 30, 2005

Related U.S. Application Data

(60) Provisional application No. 60/542,471, filed on Feb. 9, 2004.

(30) Foreign Application Priority Data

Dec. 22, 2003 (FR) ..... 03 15191

(51) Int. Cl.
*B65D 83/76* (2006.01)

(52) U.S. Cl. ..... 222/321.7; 222/321.2; 222/340; 222/383.1

(58) Field of Classification Search ..... 222/321.2, 222/383.1, 340, 385, 321.7–321.9, 320, 321.1, 222/380–382, 383.3
See application file for complete search history.

(56) References Cited

U.S. PATENT DOCUMENTS 3,759,426 A 9/1973 Kane et al.
4,046,495 A 9/1977 Grimm, Jr.
4,315,582 A * 2/1982 Micallef ..... 222/148
4,369,900 A * 1/1983 Saito et al. ..... 222/321.2
5,947,340 A * 9/1999 Arnold et al. ..... 222/321.9
6,932,246 B2 * 8/2005 Crosnier et al. ..... 222/321.2

FOREIGN PATENT DOCUMENTS

FR 2 825 348 A1 12/2002
JP 55-129171 A 12/1980

* cited by examiner

*Primary Examiner*—J. Casimer Jacyna
(74) *Attorney, Agent, or Firm*—Sughrue Mion, PLLC

(57) ABSTRACT

A fluid dispenser member comprising: a body designed to be associated with a receptacle; a dispenser head mounted to move in axial translation relative to the body over an actuation stroke, said head comprising a pusher comprising a push wall, and a side wall extending from said push wall; a chamber defined between said body and said head, said chamber being provided with an inlet valve and an outlet valve; and a dispensing orifice via which the fluid is dispensed; said fluid dispenser member being characterized in that said pusher is provided with an axial rod, said axial rod forming said at least one valve, namely said inlet valve and/or said outlet valve, in co-operation with at least one of the components, and in that said dispenser head further comprises an insert associated with the pusher so that it is constrained to move therewith.

17 Claims, 4 Drawing Sheets

FLUID DISPENSER

CROSS REFERENCE TO RELATED APPLICATION

This application claims the benefit under 35 U.S.C. §119 (e) of U.S. provisional patent application Ser. No. 60/542,471, filed Feb. 9, 2004, and priority under 35 U.S.C. §119(a)-(d) of French patent application No. FR-03.15191, filed Dec. 22, 2003.

TECHNICAL FIELD

The present invention relates to a fluid dispenser member comprising the following components: a body designed to be associated with a receptacle; a dispenser head mounted to move in axial translation relative to the body, said head being mounted to move relative to the body over an actuation stroke, said head comprising a pusher comprising a push wall defining a push outside surface and an inside surface, and a side wall extending from said push wall, said side wall having an outside surface and an inside surface; a chamber defined between said body and said head, said chamber being provided with at least one valve, namely an inlet valve and/or an outlet valve; and a dispensing orifice via which the fluid is dispensed. The present invention also relates to a fluid dispenser incorporating such a dispenser member and that can be used, in particular, in the pharmaceuticals or cosmetics sectors.

BACKGROUND OF THE INVENTION

Currently, numerous fluid dispenser systems exist that integrate pumps as dispenser members. Such systems can have structural and functional characteristics that differ to varying extents. Therefore, such devices also vary in cost and in ease of assembly. Such fluid dispensers comprise a receptacle, a dispenser member such as a pump or a valve, mounted on said receptacle, and a pusher making it possible to actuate said dispenser member in order to dispense a volume of fluid contained in the receptacle through a dispensing orifice. In addition, most of such devices contain a chamber having an inlet valve and/or an outlet valve isolating the fluid contained in the receptacle from the outside.

For example, Document WO 02/096776 discloses a dispenser device in which a middle end-piece is integrated into a pusher in order to serve as a moving inlet valve member. In that case, the pusher being actuated firstly causes contact to be established with a piston which is then moved in axial translation. That movement then simultaneously causes the inlet valve to close and the outlet valve to open. The piston moving downwards then causes the volume of the pump chamber to decrease, thereby causing the fluid contained in said chamber to be discharged. The piston is then returned to its rest position. The pusher separates from the piston, which remains temporarily stationary. The piston and the pusher moving relative to each other causes the inlet valve to open in order to put the chamber into communication with the receptacle, and causes the outlet valve to be closed simultaneously in order to isolate the chamber from the outside. Thus, the piston remains stationary until a shoulder on the pusher comes into abutment against a corresponding shoulder on the piston. The piston is then driven in translation and goes back up to its initial position, thereby generating suction in the chamber, so that the fluid contained in the receptacle is sucked up.

Thus, that dispenser device as disclosed does not incorporate pre-compression, since the inlet and the outlet valve are opened and closed simultaneously, independently of any increase in pressure in the pump chamber. In addition, in the invention, the piston and middle end-piece move synchronously over only a short distance of the actuation stroke of the pusher, it being necessary for these two elements to move at distinct axial translation speeds in order for the above-described pump to operate correctly. Therefore, the dispenser device of that patent has a complex operating principle, making it difficult to manufacture and assemble said device and making its cost significantly high.

SUMMARY OF THE INVENTION

An object of the present invention is to provide a dispenser member and a fluid dispenser incorporating such a dispenser member that does not suffer from the above-mentioned drawbacks.

In particular, an object of the present invention is to provide a dispenser member such as a pre-compression pump that prevents any risk of the fluid being contaminated, and that guarantees firstly good leaktightness and secondly good reproducibility of the metered quantities or "doses" dispensed each time it is actuated.

Another object of the present invention is to provide a dispenser member and a dispenser incorporating such a dispenser member that is simple to manufacture, simple to assemble, and whose cost is relatively low;

The present invention proposes to solve the above-mentioned problems by developing a fluid dispenser member comprising the following components:

- a body designed to be associated with a receptacle;
- a dispenser head mounted to move in axial translation relative to the body, said head being mounted to move relative to the body over an actuation stroke A, said head comprising a pusher comprising a push wall defining a push outside surface and an inside surface, and a side wall extending from said push wall, said side wall having an outside surface and an inside surface;
- a chamber defined between said body and said head, said chamber being provided with at least one valve, namely an inlet valve and/or an outlet valve; and
- a dispensing orifice via which the fluid is dispensed;

said fluid dispenser member being characterized in that said pusher is provided with an axial rod, said axial rod forming said at least one valve, namely said inlet valve and/or said outlet valve, in co-operation with at least one of the components, and in that said dispenser head further comprises an insert associated with the pusher so that it is constrained to move therewith.

Advantageously, said insert and said axial rod are constrained to move together over the entire actuation stroke of said dispenser head.

Advantageously, said axial rod is provided with an outlet valve seat suitable for co-operating with said insert, said insert being provided with a moving outlet valve member.

Advantageously, said outlet valve seat has a cylindrical surface suitable for co-operating with an annular lip on the moving outlet valve member to put said chamber into communication with a discharge space which advantageously extends around said axial rod.

Advantageously, said insert is provided with an outlet channel connecting said discharge space to the dispensing orifice.

Advantageously, the insert comprises a ring in engagement with said inside surface of the side skirt, a radial flange in engagement with said inside surface of the push wall, and a bushing, said bushing being provided with a piston lip in leaktight sliding contact with said body.

Advantageously, the insert is a deformable single piece.

Advantageously, said axial rod is provided with a moving inlet valve member suitable for co-operating with an inlet valve seat formed by said body.

Advantageously, said moving inlet valve member is provided with at least one longitudinal groove suitable for co-operating with an annular rib of the inlet valve seat for putting said receptacle into communication with said chamber.

Advantageously, said side skirt is provided with said dispensing orifice.

Advantageously, the ring of the insert is provided with a swirl system, said swirl system being situated facing the dispensing orifice.

In a variant, the inside surface of the skirt forms a swirl system facing the dispensing orifice, said swirl system being formed integrally with said side skirt. This is a characteristic that can be implemented independently of the fact that the pusher forms an axial valve member rod. In this example, the swirl system is completed by the insert which is received in fixed manner in the pusher.

The present invention also provides a fluid dispenser comprising a receptacle and a fluid dispenser member of the invention. In particular, the dispenser member is entirely adaptable to miniature dispensers such as dispenser used for samples.

Thus, the axial rod, which is preferably formed integrally with the pusher, acts as an inlet or outlet moving valve member or seat. The insert engaged in fixed manner in the pusher is made separately for technical reasons of molding. However, the insert may be formed integrally with the pusher, so that the dispenser head is then formed of a single piece.

BRIEF DESCRIPTION OF THE DRAWINGS

Other characteristics and advantages of the present invention appear more clearly from the following detailed description of embodiments of the present invention, given by way of non-limiting example, and with reference to the accompanying drawings, in which.

DETAILED DESCRIPTION OF THE PREFERRED EMBODIMENTS

Figure 1:
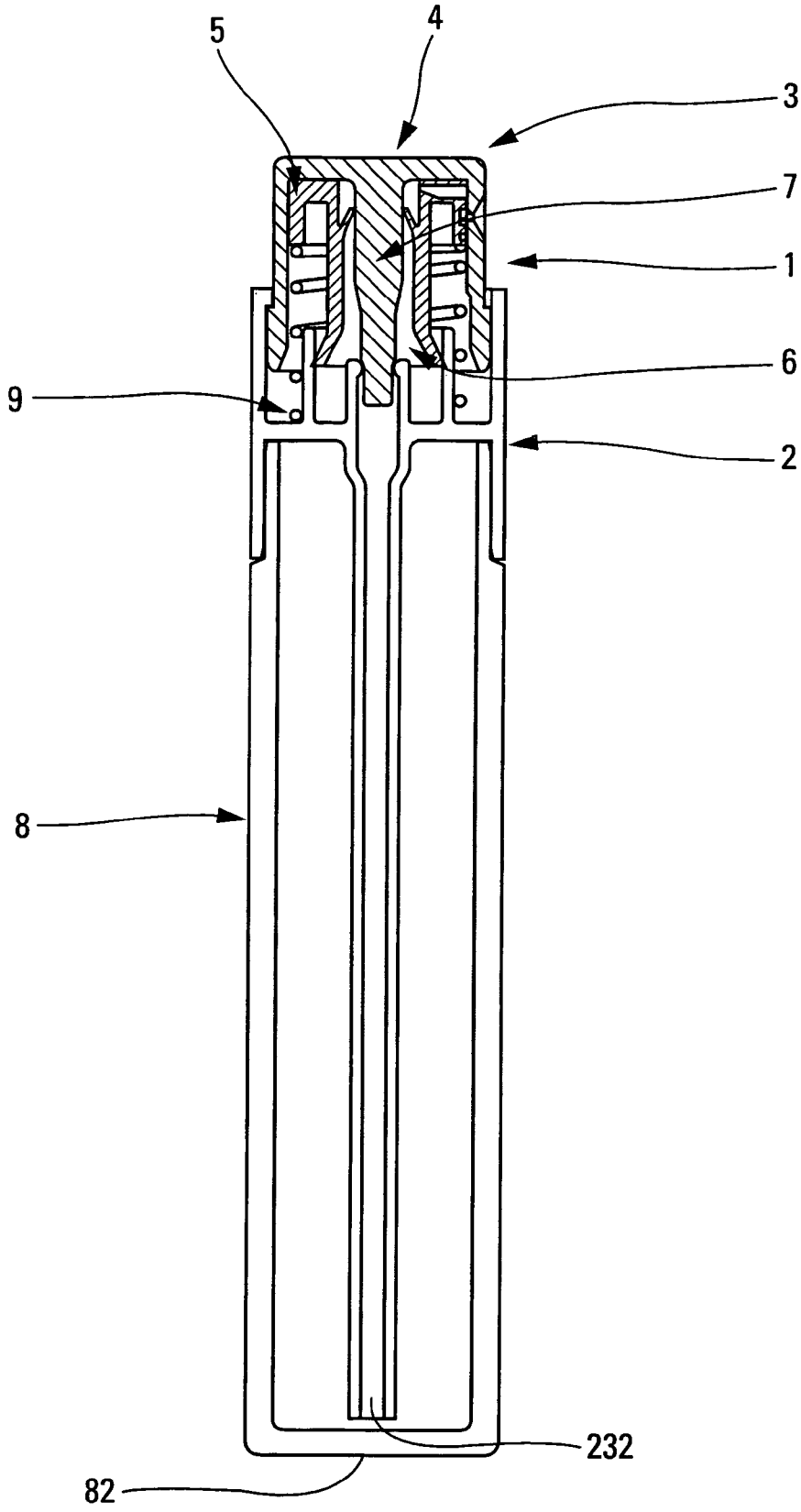
FIG. 1 is an overall diagrammatic section view of a fluid dispenser incorporating a dispenser member of the invention.

As shown in the figures, a fluid dispenser of the present invention is made up of two component elements, namely, a dispenser member 1 and a receptacle 8.

The receptacle 8 has an opening 80 that puts the inside of said receptacle 8 into communication with the outside, a neck 83, a side wall 81 extending from the neck 83 and an end-wall 82. The receptacle 8 advantageously has a cylindrical shape and may be made of any suitable material: metal, plastic, glass, or some other material. The side wall 81 has an outside surface 810 in contact with the outside, and an inside surface 811 defining a fluid reservoir. The neck 83 advantageously has a fastening segment at its outside surface 810, which segment serves to receive the dispenser member 1.

The dispenser member 1 comprises a dispenser head 3, and a body 2 designed to be associated with the receptacle 8.

The body 2 may be fixed to the neck 83 of the receptacle 8 by any means. The body 2 is axially and circularly symmetrical, and is suitable for fitting over the neck of the receptacle 8. The body 2 comprises a radial plate 20 from which a peripheral wall 21, a drum 22, and a sleeve 23 extend.

The peripheral wall 21 extends upwards and downwards from the radial plate 20. The peripheral wall 21 has an outside surface 210 and an inside surface 211. The bottom portion of the wall 21 is advantageously fitted onto the neck of the receptacle 2 so that the radial plate 22 comes to rest on the neck of the receptacle, and so that the inside surface 211 comes into engagement with the outside surface 810 of the receptacle 8. Advantageously, as a result of the wall and the neck being fitted together in this way, the outside surface 210 of the peripheral wall 21 of the body 2 is placed in alignment with the outside surface 810 of the receptacle 8 in order to give the dispenser an overall shape that is uniform and advantageously cylindrical. At its inside surface 211, the peripheral wall 21 can also be provided with an internal projection 2100 serving as a top abutment for the dispenser head 3.

The drum 22 defines a leaktight sliding surface for a bushing 55 forming a piston element.

The sleeve 23 forms an inlet valve seat 230 suitable for co-operating with a moving inlet valve member 70. The valve seat 230 is advantageously in the form of an annular rib. The sleeve 23 is advantageously extended downwards into the receptacle so as to form a dip tube 231 provided with a passageway 232 via which the fluid can pass.

The body 2 as described is advantageously made in one piece so as to facilitate assembly of the dispenser member. The body 2 may be made of any suitable material: metal, plastic, or some other material.

The dispenser head 3 advantageously comprises two component elements, namely a pusher 4 and an insert 5. The dispenser head 3 is mounted to move on the body 2 so that it can move axially relative to the body 2 over an actuation stroke A.

The pusher 4 has a push wall 40 defining an inside surface 401 and a push outside surface 400, and a side skirt 41 extending downwards from said push wall 40.

The side skirt 41 has an outside surface 410 and an inside surface 411. The outside surface 410 advantageously has an external shoulder 4100 serving to co-operate with the internal projection 2100 of the peripheral wall 21 of the body 2 to form a top abutment. Thus, said abutment makes it possible to define the rest position for the dispenser member 1, and guarantees a tamper-proofing function for preventing the dispenser head from being torn off. It should be noted that, in the embodiment as shown, a portion of the inside surface 211 that is situated between the internal projection 2100 and the radial plate 22 serves as a guide wall for guiding the pusher 4, thereby guaranteeing that the pusher is axially positioned better while it is moving.

A dispensing orifice 42 is advantageously provided in the side skirt 41. The dispensing orifice 42 can then be situated at the end of a channel in a dispensing spout 43.

In the invention, the pusher 4 is provided with an axial rod 7 which is constrained to move axially with said pusher. The rod is optionally formed integrally with said pusher. The axial rod 7 advantageously extends from the push wall 40 into the sleeve 23. The axial rod 7 advantageously has a cylindrical shape similar to the shape of the sleeve 23. The axial rod 7 forms the moving inlet valve member 70 suitable for co-operating with the inlet valve seat 230 of the sleeve 23. The moving inlet valve member 70 is advantageously in the form of at least one longitudinal groove provided along the axial rod 7 over a height such that the fluid can pass along said grooves to reach a chamber 6 located between the dispenser head 3 and the body 2. The axial rod 7 is also provided with an outlet valve seat 71, said outlet valve seat 71 then advantageously defining a cylindrical surface suitable for co-operating with a moving outlet valve member 51.

The insert 5 is made of an elastically deformable material. It advantageously comprises a ring 53, a radial flange 54, and a bushing 55. The insert 5 is advantageously fitted into the pusher 4 so that the ring 53 comes into engagement with the inside surface 411 of the side skirt 41, and so that the radial flange 54 comes into engagement with the inside surface 401 of the push wall 40. The bushing 55 is provided with a moving outlet valve member comprising an annular valve lip 51 suitable for co-operating with the outlet valve seat 71, and said bushing is terminated by a piston lip 550 suitable for sliding in leaktight manner in the drum 22 of the body 2.

Thus, once the dispenser head 3 is mounted on the body 2, the chamber 6 extends around the axial rod 7 and occupies a volume extending from a portion of the radial plate 22 that is situated between the drum 22 and the sleeve 23 to the outlet valve 51, 71.

Figure 2:
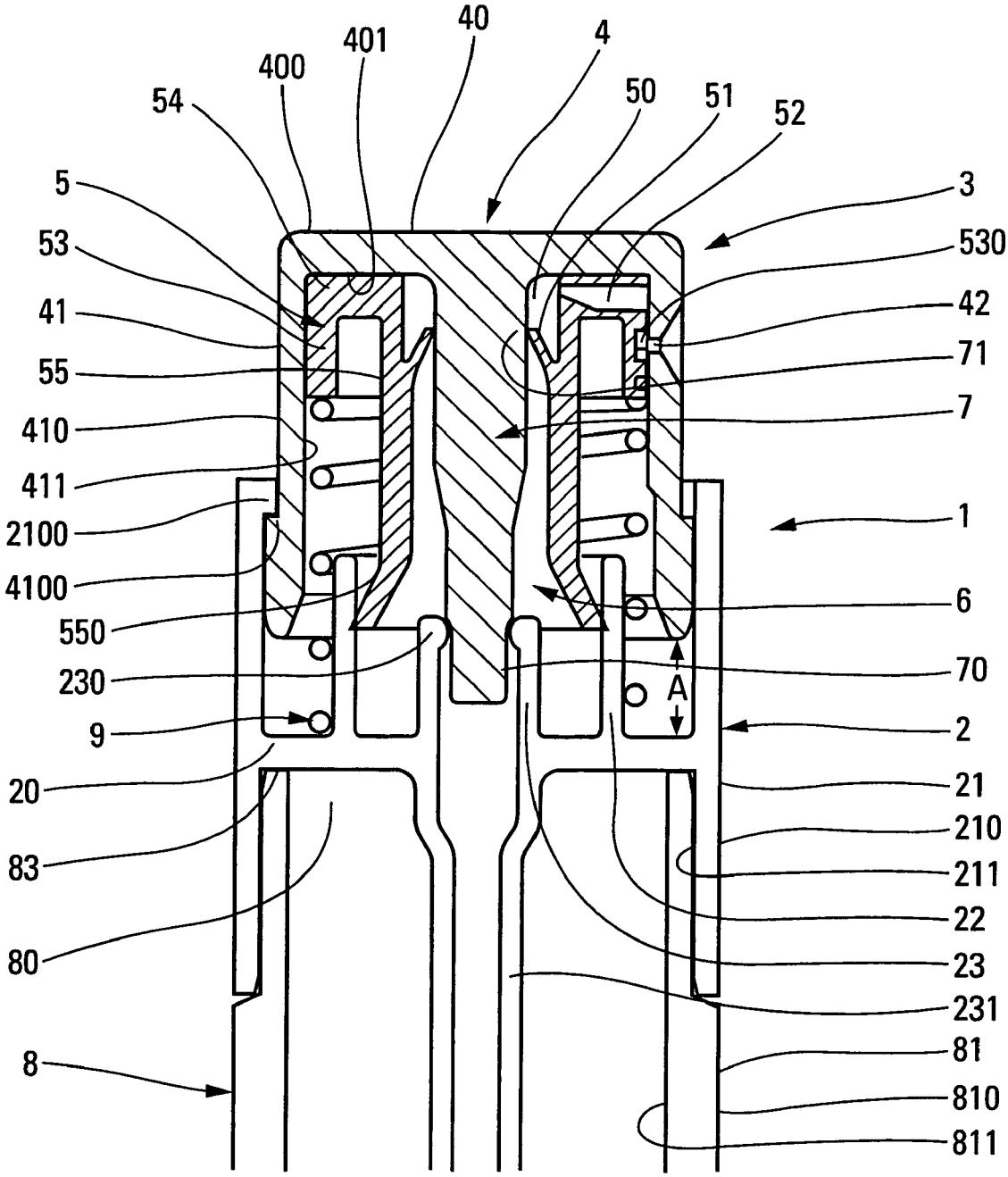
FIG. 2 is a larger-scale view of the dispenser of FIG. 1, and in particular of the dispenser member of the invention.
Figure 3:
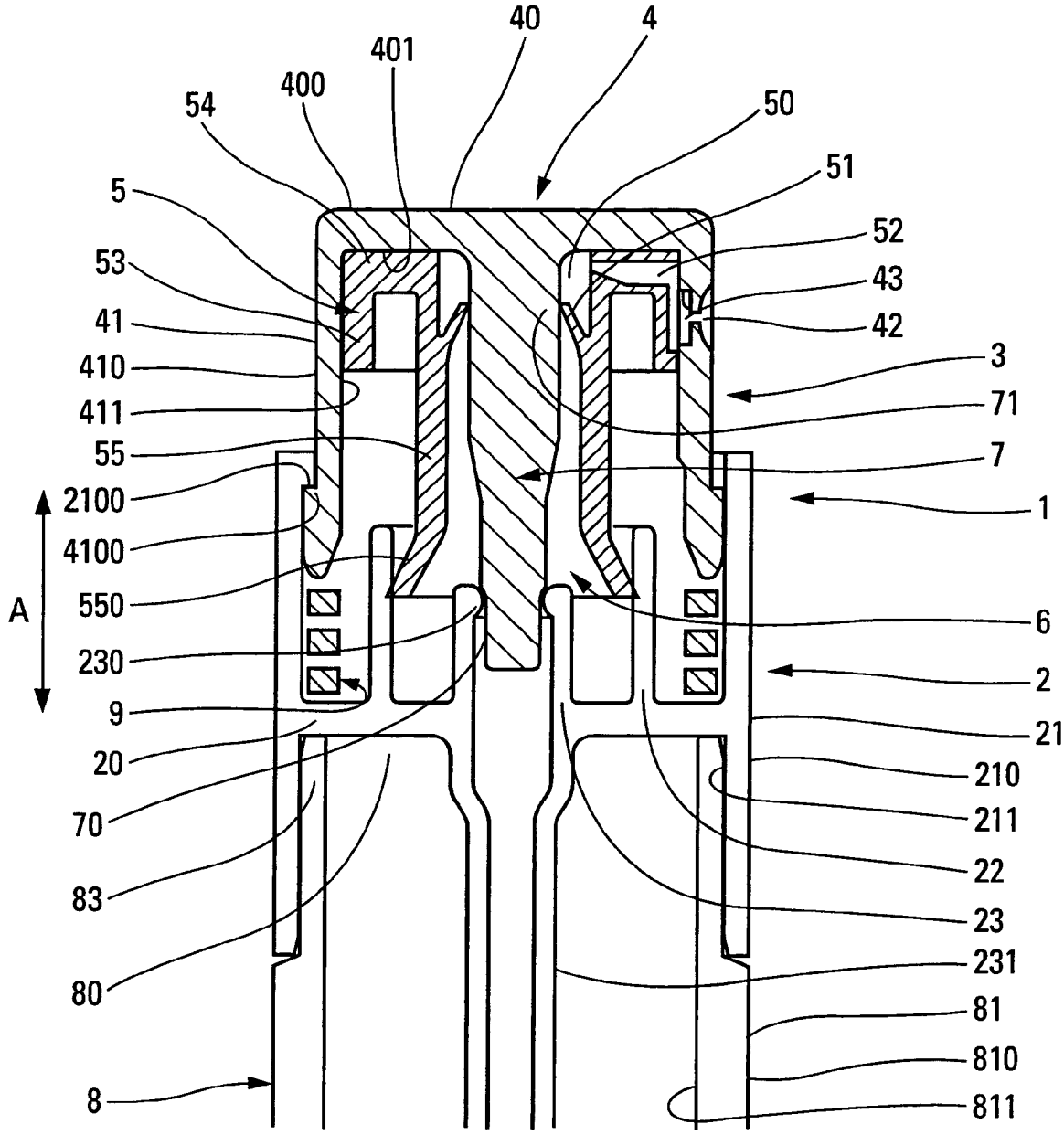
FIG. 3 is a larger-scale view of a variant embodiment of the dispenser of the invention.

In the example shown, an outlet channel 52 passes through the insert 5 and makes it possible to put a discharge space 50 into communication with the dispensing orifice 42. The discharge space 50 extends around the axial rod, thereby forming an annular space extending from the outlet valve 51, 71 to the inside surface 401 of the push wall 40 of the pusher 4. It should be noted that an array of recesses 530 can be provided at the ring 53 of the insert as shown in FIG 2. The array forms a swirl system. In FIG. 3, it is the inside wall 411 of the skirt, at the dispensing orifice 42, that forms a swirl system 43 which is completed by the outside surface of the ring 53 formed by the insert 5.

Figure 4:
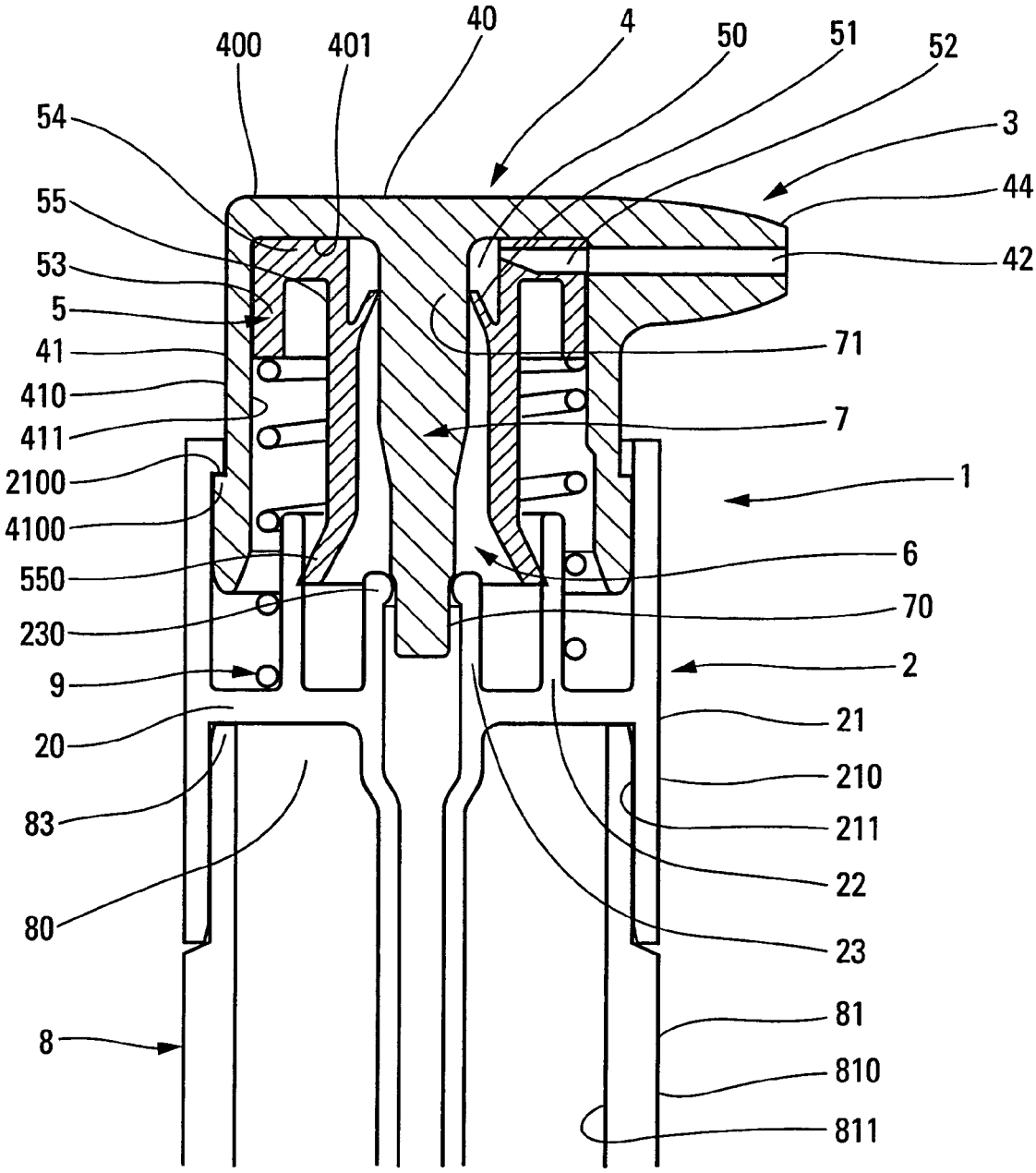
FIG. 4 is a larger-scale view of another variant embodiment of the dispenser of the invention.

In FIG. 4, the dispenser head is not provided with a swirl chamber, but rather it is provided with a dispenser spout 43 that puts the outlet channel 52 directly into communication with the dispensing orifice 42 situated at the end of the spout.

A return spring 9 can advantageously extend from the radial plate 22 between the peripheral wall 21 and the drum 22 to the ring 53 of the insert 5, as shown in FIG. 1, or it can be received between the radial plate 22 and the bottom end of the side skirt 41, as shown in FIG. 2. In which case, it is possible to consider implementing a return spring 9 and a pusher 4 that are made in one piece.

Operation of the dispenser incorporating the dispenser member of the invention is described below with reference to FIGS. 1, 2, and 3, showing a dispenser member in a rest position.

In said rest position, a quantity of fluid is contained in the chamber 6, the inlet valve 70, 230 is open, and the outlet valve 51, 71 is closed.

When the user wishes to dispense fluid, said user actuates the dispenser member 1 by pressing on the push wall 40 of the pusher 4. This causes the dispenser head 3 to move axially relative to the body 2 which remains stationary. Said dispenser head moving thus causes the outside surface 410 of the side skirt 41 to slide against the inside surface 211 of the peripheral wall 21, and causes the piston lip 550 on the bushing 55 to slide against the drum 22. In addition, the axial rod 7 constrained to move with the pusher 4 penetrates into the sleeve 23. Said axial rod 7 sliding into the sleeve 23 causes the inlet valve 70, 230 to close, it then no longer being possible for the fluid contained in the receptacle 2 to access the chamber 6. The dispenser head moving downwards also causes the pressure in the chamber 6 to increase, thereby causing the outlet valve 51, 71 to open. Thus, the fluid initially present in the chamber 6 can be driven out therefrom due to the volume of said chamber 6 being reduced. The fluid then passes through the open outlet valve and reaches the discharge space 50 and then an outlet channel 52. The fluid in the outlet channel 52 then reaches the swirl system which is centered on the dispensing orifice 42. The fluid is then discharged. The discharge can continue until the bottom end of the side skirt 41 comes into abutment against the radial plate 22, which is synonymous with the fluid contained in the chamber 6 having been discharged in full or almost in full.

When the user ceases to press on the wall 40 of the pusher 4, the return spring 9 automatically causes the dispenser head 3 to go back up. The dispenser head 3 going back up constrains the piston lip 550 on the bushing 55 to go back up, thereby opening the inlet valve 70, 230 and closing the outlet valve 51, 71. The piston 550 moving relative to the body 2 then generates suction at the chamber 6, causing the fluid enclosed in the receptacle to be sucked up. Thus, the fluid reaches the dip tube 231 by flowing along the passageway 232 and reaches the inlet valve 70, 230 situated at the sleeve 23. The fluid then passes along the longitudinal grooves in the moving inlet valve member 70, and finally reaches the chamber 6. The chamber 6 fills so long as the external shoulder 4100 of the side wall 41 does not come into abutment against the internal projection 2100 of the peripheral wall 21 of the body 2. Once the dispenser head 3 is in abutment against the body 2, the rest position is reached, and a cycle can be triggered again by the user.

The invention claimed is:

1. A fluid dispenser member (1) comprising the following components:

a body (2) designed to be associated with a receptacle (8);

a dispenser head (3) mounted to move in axial translation relative to the body (2), said head (3) being mounted to move relative to the body (2) over an actuation stroke A, said head (3) comprising a pusher (4) comprising a push wall (40) defining a push outside surface (400) and an inside surface (401), and a side wall (41) extending from said push wall (40), said side wall (41) having an outside surface (410) and an inside surface (411);

a chamber (6) defined between said body (2) and said head (3), said chamber (6) being provided with an inlet valve (230, 70) and an outlet valve (51, 71); and a dispensing orifice (42) via which the fluid is dispensed;

said fluid dispenser member being characterized in that said pusher (4) is provided with an axial rod (7), said axial rod (7) forming said at least one valve, namely said inlet valve (230, 70) and/or said outlet valve (51, 71), in co-operation with at least one of the components, and in that said dispenser head (3) further comprises an insert (5) associated with the pusher (4), wherein the insert is firmly attached to the pusher so that it is always constrained to move therewith, and wherein said axial rod (7) is provided with an outlet valve seat (71) suitable for co-operating with said insert (5), said insert (5) being provided with a moving outlet valve member (51).

2. A fluid dispenser member according to claim 1, in which said insert (5) and said axial rod (7) are constrained to move together over the entire actuation stroke A of said dispenser head (3).

3. A fluid dispenser member according to claim 1, in which said outlet valve seat (71) has a cylindrical surface suitable for co-operating with an annular lip on the moving outlet valve member (51) to put said chamber (6) into communication with a discharge space (50) which advantageously extends around said axial rod (7).

4. A fluid dispenser member according to claim 1, in which said insert (5) is provided with an outlet channel (52) connecting said discharge space (50) to the dispensing orifice (42).

5. A fluid dispenser member according to claim 1, in which the insert (5) is a deformable single piece.

6. A fluid dispenser member according to claim 1, in which said axial rod is provided with a moving inlet valve member (70) suitable for co-operating with an inlet valve seat (230) formed by said body (2).

7. A fluid dispenser member according to claim 1, in which said moving inlet valve member (70) is provided with at least one longitudinal groove suitable for co-operating with an annular rib of the inlet valve seat (230) for putting said receptacle (8) into communication with said chamber (6).

8. A fluid dispenser member according to claim 1, in which said side wall (41) is provided with said dispensing orifice (42).

9. A fluid dispenser member according to claim 1, in which the inside surface of the skirt forms a swirl system (43) centered on the dispensing orifice.

10. A fluid dispenser comprising:

a receptacle (8);

a body (2) designed to be associated with the receptacle (8);

a dispenser head (3) mounted to move in axial translation relative to the body (2), said head (3) being mounted to move relative to the body (2) over an actuation stroke A, said head (3) comprising a pusher (4) comprising a push wall (40) defining a push outside surface (400) and an inside surface (401), and a side wall (41) extending from said push wall (40), said side wall (41) having an outside surface (410) and an inside surface (411);

a chamber 6 defined between said body (2) and said head (3), said chamber (6) being provided with an inlet valve (230, 70) and an outlet valve (51, 71); and a dispensing orifice (42) via which the fluid is dispensed;

said fluid dispenser member being characterized in that said pusher (4) is provided with an axial rod (7), said axial rod (7) forming said at least one valve, namely said inlet valve (230, 70) and/or said outlet valve (51, 71), in co-operation with at least one of the components, and in that said dispenser head (3) further comprises an insert (5) associated with the pusher (4), wherein the insert is firmly attached to the pusher so that it is always constrained to move therewith, and wherein said axial rod (7) is provided with an outlet valve seat (71) suitable for co-operating with said insert (5), said insert (5) being provided with a moving outlet valve member (51).

11. A fluid dispenser member (1) comprising the following components:

a body (2) designed to be associated with a receptacle (8);

a dispenser head (3) mounted to move in axial translation relative to the body (2), said head (3) being mounted to move relative to the body (2) over an actuation stroke A, said head (3) comprising a pusher (4) comprising a push wall (40) defining a push outside surface (400) and an inside surface (401), and a side wall (41) extending from said push wall (40), said side wall (41) having an outside surface (410) and an inside surface (411);

a chamber (6) defined between said body (2) and said head (3), said chamber (6) being provided with an inlet valve (230, 70) and an outlet valve (51, 71); and a dispensing orifice (42) via which the fluid is dispensed;

said fluid dispenser member being characterized in that said pusher (4) is provided with an axial rod (7), said axial rod (7) forming said at least one valve, namely said inlet valve (230, 70) and/or said outlet valve (51, 71), in co-operation with at least one of the components, and in that said dispenser head (3) further comprises an insert (5) associated with the pusher (4), wherein the insert is firmly attached to the pusher so that it is always constrained to move therewith, and wherein the insert (5) comprises a ring (53) in engagement with said inside surface (411) of the side wall (41), a radial flange (54) in engagement with said inside surface (401) of the push wall (40), and a bushing (55), said bushing (55) being provided with a piston lip (550) in leaktight sliding contact with said body (2).

12. A fluid dispenser member according to claim 11, in which the ring (53) of the insert (5) is provided with a swirl system (530), said swirl system being situated facing the dispensing orifice (42).

13. A fluid dispenser member according to claim 11, in which said insert (5) and said axial rod (7) are constrained to move together over the entire actuation stroke A of said dispenser head (3).

14. A fluid dispenser member according to claim 11, in which said axial rod is provided with a moving inlet valve member (70) suitable for co-operating with an inlet valve seat (230) formed by said body (2).

15. A fluid dispenser member according to claim 11, in which said moving inlet valve member (70) is provided with at least one longitudinal groove suitable for co-operating with an annular rib of the inlet valve seat (230) for putting said receptacle (8) into communication with said chamber (6).

16. A fluid dispenser member according to claim 11, in which said side wall (41) is provided with said dispensing orifice (42).

17. A fluid dispenser comprising:

a receptacle (8);

a body (2) designed to be associated with the receptacle (8);

a dispenser head (3) mounted to move in axial translation relative to the body (2), said head (3) being mounted to move relative to the body (2) over an actuation stroke A, said head (3) comprising a pusher (4) comprising a push wall (40) defining a push outside surface (400) and an inside surface (401), and a side wall (41) extending from said push wall (40), said side wall (41) having an outside surface (410) and an inside surface (411);

a chamber (6) defined between said body (2) and said head (3), said chamber (6) being provided with an inlet valve (230, 70) and an outlet valve (51, 71); and dispensing orifice (42) via which the fluid is dispensed;

said fluid dispenser member being characterized in that said pusher (4) is provided with an axial rod (7), said axial rod (7) forming said at least one valve, namely said inlet valve (230, 70) and/or said outlet valve (51, 71), in co-operation with at least one of the components, and in that said dispenser head (3) further comprises an insert (5) associated with the pusher (4), wherein the insert is firmly attached to the pusher so that it is always constrained to move therewith, and wherein the insert (5) comprises a ring (53) in engagement with said inside surface (411) of the side wall (41), a radial flange (54) in engagement with said inside surface (401) of the push wall (40), and a bushing (55), said bushing (55) being provided with a piston lip (550) in leaktight sliding contact with said body (2).

* * * * *